United States Patent [19]

Squires

[11] 4,006,533

[45] Feb. 8, 1977

[54] TREATING GAS AND GRANULAR MATERIAL IN PANEL BED

[76] Inventor: Arthur M. Squires, 245 W. 104th St., New York, N.Y. 10025

[22] Filed: Aug. 28, 1974

[21] Appl. No.: 501,276

[52] U.S. Cl. ..... 34/33; 34/168; 55/96; 55/98; 55/282; 55/479

[51] Int. Cl.² ..... F26B 3/00

[58] Field of Search ..... 34/33, 168; 55/96, 98, 55/479, 474, 517

[56] References Cited

UNITED STATES PATENTS

| | | | |
|---|---|---|---|
| 3,296,775 | 1/1967 | Squires | 55/98 |
| 3,410,055 | 11/1968 | Zenz | 55/96 |
| 3,912,466 | 10/1975 | Zenz | 55/96 |

*Primary Examiner*—Bernard Nozick

[57] ABSTRACT

There is provided a puffback technique for cleaning a panel bed contactor suitable for chemical or physical treatment of gas and granular material. Free surfaces for entry of gas are supported cooperatively by louvers. A puffback technique is provided for cleaning the gas entry surfaces to rid them of granular material "spent" by the treatment, including accumulated dust if the treatment includes filtration to remove dust from a gas. The puffback consists of a reverse transient flow across the panel bed of an intensity moderated so that the reverse pressure differential exceeds a first critical minimum for a time interval between about 5 and 150 milliseconds (preferably less than 50 milliseconds if the treatment includes filtration) and achieves a top value beyond a second critical minimum. After the panel bed is first filled with a granular gas-treating material, the bed is preferably loosened before treating operations begin, and the loosening can be accomplished by discharging a controlled quantity of material from the bottom of the bed.

3 Claims, 15 Drawing Figures

TREATING GAS AND GRANULAR MATERIAL IN PANEL BED

CROSS-REFERENCE TO RELATED APPLICATIONS

This application is related to my co-pending applications, filed simultaneously herewith, numbered and entitled as follows:

2. Filtering Dusty Gas in Improved Panel Bed Ser. No. 501,278,
3. Countercurrent Contacting of Gas and Granular Material in Panel Bed Ser. No. 501,277,
4. Treating Gas and Fine Granular Material in Panel Bed Ser. No. 501,275, The instant application is the first of this sequence.

FIELD OF THE INVENTION

The invention relates to the intimate contacting of a gas and a granular solid material for the purpose of chemically or physically treating one or both of these substances, for example, to filter a dust from the gas or to effect a chemical change in gas or solid or to remove a chemical constituent of the gas by absorption or adsorption or to heat a cold gas by contact with a hot solid. Specifically, contact is improved by a new transient reverse flow gas treatment of the granular solid.

DESCRIPTION OF THE PRIOR ART

In numerous attempts to follow the teaching of U.S. Pat. No. 3,296,775, disappointing results were sometimes obtained, as well as results that often were quite satisfactory. Sometimes, however, the desired mass movement was accompanied by undesirable localized spills, and sometimes the latter overwhelmed the former. These disappointments taught me that only a reverse transient surge flow of a particular character can produce satisfactory cleaning and renewal of the gas entry faces.

An old idea is to treat a gas with granular solid by causing the gas to flow in the horizontal direction across a bed of the granular solid disposed in a narrow "panel" that has often been relatively tall by comparison with its width in the direction of gas flow. Often, the "panel bed" has been held in place by louvered walls that resembled venetian blinds. [See *A Theoretical and Practical Treatise on the Manufacture of Sulphuric Acid and Alkali with the Collateral Branches*, volume 3, Jan van Voorst, London, England, 1880, pages 248–274. See also a review article in *Journal of the Air Pollution Control Association*, volume 20, pages 534–538, Aug. 1970, where many references are given.] Proposals have been made to use panel beds for physical treatment such as gas filtration and liquid filtration, as well as a variety of chemical applications, such as removal of sulfur dioxide from a gas by absorption by lime or adsorption by charcoal.

Some proposals have suggested addition of means for removing "spent" granular solid (along with filter cake, if present) from each gas entry surface of the panel bed, for example, moving plows that scrape each surface [U.S. Pat. No. 2,287,983 (June 30, 1942) and British Pat. No. 194,730 (Sept. 20, 1923)], or means for rocking each louver [British Pat. No. 450,048 (July 9, 1936)] or retracting each louver [U.s. Pat. No. 1,095,676 (May 5, 1914)] to induce a spill of solid from each gas entry surface. U.S. Pat. No. 3,800,508 (Apr. 2, 1974) teaches that gas entry surfaces may be held in place during gas filtration at an angle steeper than the normal angle of repose of the granular medium, and that a momentary spill from each gas entry surface can be induced by a momentary reduction in flow of gas to each surface in turn.

Backwashing a panel bed that has been used to filter a dirty liquid is an old idea [U.S. Pat. No. 557,177 (Mar. 31, 1896); U.S. Pat. No. 631,143 (Aug. 15, 1899); U.S. Pat. No. 989,665 (Apr. 18, 1911); French Pat. No. 474,615 (Mar. 2, 1915)]. In trials of this old teaching, however, I have not succeeded in effecting the removal of a filter cake present upon liquid-entry surfaces of a panel. Contrary to the impression given by a reading of these references, backwashing merely produces a localized spill of solid, originating in the interior of the panel bed, that removes little filter cake, if indeed any at all.

U.S. Pat. No. 1,608,678 (Nov. 30, 1926) taught use of an "explosive shock" resulting from the backfire of an internal-combustion engine, to which fuel gas was supplied via a panel bed filter of granular solid retained between two surfaces of felt cloth, to dislodge filter cake from the gas-entry, gas-filtering cloth surface. In one embodiment, this patent showed louvers extending beyond the gas-entry cloth surface, which, as best understood, were for the purpose of catching the dislodged filter cake and preventing it from falling to the bottom of the filter chamber.

U.S. Pat. No. 2,780,363 Feb., 1957) taught use of a sudden expansion of gas from a reservoir to drive a liquid across a fixed-medium filter in a "surge" flow in the direction opposite to the flow of dirty liquid being treated, for the purpose of dislodging filter cake adhering to the fixed filtering surface.

Shock cleaning of cloth filters is of course well known in many references.

The proceedings of the Seventh Atomic Energy Commission Air Cleaning Conference, Oct. 1961, page 127, reported experiments in which shock cleaning was attempted for slag-wool filters suitable for filtering dust from a gas at a high temperature.

Various proposals would fluidize a granular bed of filtration medium to clean the bed of captured dust, including U.S. Pat. No. 3,410,055 (Nov. 12, 1968) [see also *Chemical Engineering Progress*, volume 69, number 5, pages 67–71 (June 1973)], where the bed was restrained between lower and upper screens, there being a gap between the upper bed surface and the upper screen, and where fluidization was accomplished by "a sharp reverse blast of gas".

My earlier U.S. Pat. No. 3,296,775 (Jan. 10, 1967) [see also the aforementioned review article] taught that a reverse surge flow of gas across a panel bed can produce a movement of the granular material in a mass toward the outer edges of louvers supporting gas-entry faces, effecting a spill of the material from each face, and removing filter cake if present. The surge flow was to peak sharply to a flow substantially above the minimum steady flow rate at which a steady reverse flow of gas just causes motion of the granular material, and thereafter was to decline substantially immediately.

GENERAL DESCRIPTION OF THE INVENTION

As a consequence of diligent experimentation (to be discussed hereinafter), I am now able to give a more particular characterization of a reverse transient flow to produce a movement of granular material in mass (a "body movement") toward the gas-entry faces of a panel gas-contacting bed. The new characterization permits achievement of improved and more reliable performance. Substantially uniform spill of spent solid (i.e., solid lacking in further virtue for the desired treatment) can be reliably provided from each gas-entry surface, and especially noteworthy is the fact that the improved control of the numerous spills from the many surfaces of a tall panel bed used to filter a dusty gas can provide improved efficiency of dust removal.

OBJECTS OF THE INVENTION

An object of the invention is to provide an improved method and apparatus for the chemical and physical treatment of at least one of a gas and a granular medium brought into contact.

Another object is to provide an improved method and apparatus for bringing a gas and a granular solid into intimate contact.

Another object is to provide a filter for dusty gas.

Another object is to provide an improved technique for periodically removing granular material adjacent to the gas entry face of a panel bed filter or panel bed contactor.

Another object is to provide a filter or solid contactor for gas at elevated temperature.

SUMMARY OF THE METHOD FEATURES OF THE INVENTION

My invention relates to an improved method of contacting gas and granular material with each other to effect physical or chemical treatment of at least one of them. Granular material is arranged in a bed having a plurality of transversely disposed, upwardly spaced, gas entry portions separated by interposed supporting members having outer and inner edges. The gas entry portions have gas entry faces that are substantially contiguous with these outer edges. The bed has gas exit portions spaced horizontally apart from the inner edges. Gas is caused to flow forwardly in a substantially continuing flow during the aforementioned treatment through the gas entry portions of the granular material bed and outwardly from the gas exit portions to effect treatment of gas or granular material or both. Thereafter, a transient flow of gas is caused to move in the direction in reverse to the aforementioned flow of gas. The transient reverse flow produces first a rise (at a given rate of rise) and subsequently a fall in the pressure difference between the gas exit portions and the gas entry portions. This difference should remain greater than a first critical minimum difference for a time interval between about 5 and about 150 milliseconds, this first critical minimum difference being that difference at which a steady flow of gas in the aforementioned reverse direction just produces a localized spill of granular material from the gas entry faces. The pressure difference produced by the transient reverse flow should peak to a top value beyond a second critical minimum difference, which is the pressure difference at which a transient flow of gas in the reverse direction, producing the second critical minimum difference at the aforementioned given rate of rise, just initiates a body movement of the granular material toward the gas entry faces to remove a portion of the granular material from the bed. The second critical minimum difference depends upon the rate of rise in the pressure difference, being larger the more rapid the rise. The aforementioned time interval is sometimes advantageously held within about 5 and about 50 milliseconds, especially for use of the invention to filter dust from a gas.

For convenience of reference, I sometimes use the term "reverse puff" or "puffback" for the specified reverse transient flow of gas. The term puffback denotes broadly the new cleaning technique provided by the invention, whereby a panel bed is rid of granular medium spent by the aforementioned treatment, along with dust captured by filtration, if any is present.

When operation of the method of the invention is initiated, just after granular material has been arranged in the bed, it is often advantageous to loosen the granular material in the bed by discharging from the bottom of the bed a controlled quantity of the material to produce a downward motion of the material in the bed including material at substantially the top of the bed.

SUMMARY OF THE APPARATUS FEATURES OF THE INVENTION

My invention also relates to an improved gas-solid contactor with a pair of upwardly extending, horizontally spaced-apart, perforate retaining walls, with means for supplying a loose solid particulate material into the space between the walls. There is a plurality of particulate-material support members each adjacent a perforation of the first perforate wall, each member being arranged to extend outwardly from below its adjacent perforation and into an inlet compartment in communication with the perforations of the first wall. The members cooperate to support and expose to the inlet compartment a plurality of free surfaces of the particulate material and to retain the material in the aforementioned space. A gas outlet compartment is in communication with the perforations of the second perforate wall. There is an inlet for admitting gas into the inlet compartment, and an outlet for removing gas from the outlet compartment. Means are provided for periodically effecting a body movement of the particulate material toward the inlet compartment of at least those portions of the particulate material including the free surfaces and which are retained on the support members. The body movement means comprise means for effecting a transient flow of gas from gas outlet compartment to gas inlet compartment that produces first a rise and subsequently a fall in the pressure difference between the gas outlet compartment and the gas inlet compartment, the pressure difference remaining greater than the aforementioned first critical minimum difference for between about 5 and about 150 milliseconds and also peaking beyond the aforementioned second critical minimum difference.

A preferred means for effecting the transient flow of gas is a source of gas under pressure and means for effecting a sudden discharge of gas from the pressure source into the outlet compartment, with volume control means for limiting the quantity of gas discharged.

Another preferred means, useful for a small installation in infrequent service, is a bellows fitted to discharge gas into the outlet compartment. Also suitable is a chamber connected to the outlet compartment and fitted with a blank cartridge mounted to discharge gas explosively into the chamber. For operation of the panel bed contactor at an elevated pressure, it will sometimes be preferable to provide a chamber at lower pressure that can be placed quickly into communication with the inlet compartment.

Means are advantageously provided, especially for operation with support members that extend upwardly from their adjacent perforations at a shallow angle, for effecting a controlled discharge of material from substantially the bottom of the space between the two perforate walls to produce a downward motion of the material in the space including material at substantially the top of the space, in order to facilitate start-up of the operation of the apparatus of the invention.

BRIEF DESCRIPTION OF THE DRAWINGS

The invention will be more particularly described in conjunction with the following drawings wherein.

DESCRIPTION OF THE PREFERRED EMBODIMENTS

Figure 1:
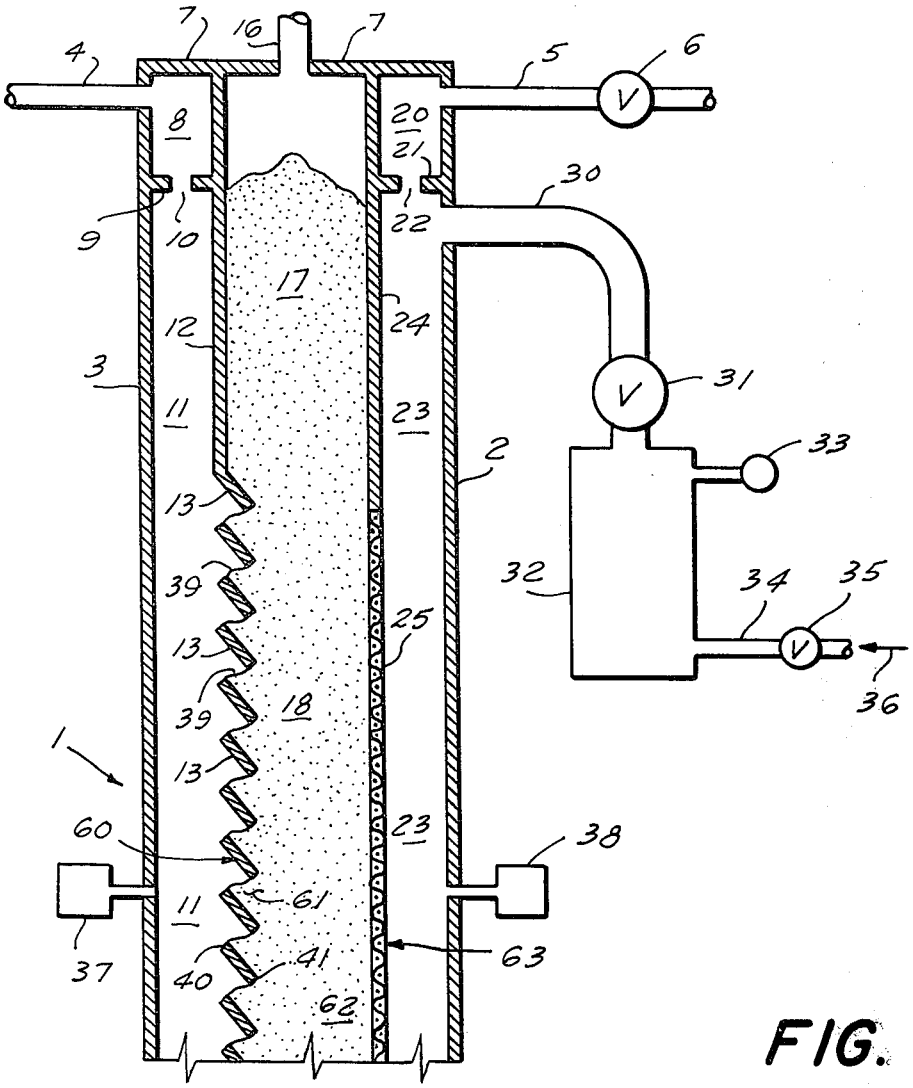
FIG. 1 is a vertical section view of a preferred contacting panel, with a bed of sand.
Figure 2:
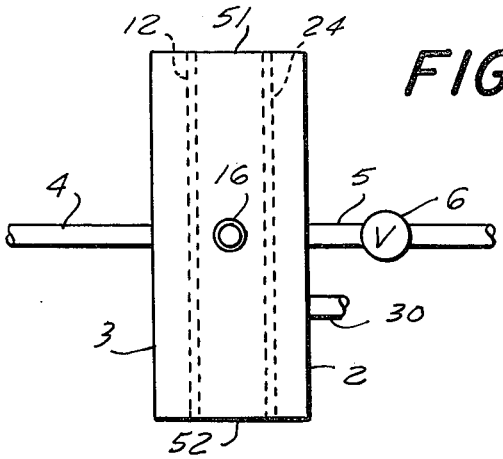
FIG. 2 is a top view of the panel bed of FIG. 1.

In the several figures, like reference numerals refer to like parts having like functions. In FIG. 1, the panel bed filter-contactor 1 comprises a casing of rectangular cross-section having opposed side walls 2 and 3 and top plate 7 and bottom plate 29. Opposed edge walls 51 and 52 are seen in FIG. 2, a top view. A generally vertical bed of granular material 18 is within the casing and retained by vertically extending, horizontally spaced-apart, perforate walls 60 and 63 which extend between the edge walls 51 and 52. Granular material is supplied by gravity feed to bed 18 from supply bed 17, retained between imperforate walls 12 and 24. Additional granular material may be added to bed 17 from pipe 16. Granular bed 18 may be drained, if desired, via space 19 between walls 14 and 26, normally filled with static granular material, by means of pipe 27 and valve 28. Perforate wall 63 comprises wire-mesh screen 25. Walls 12, 60, 14, 3, 51, and 52, bottom 29, and partition 9 enclose gas entry compartment 11, to which gas to be treated is supplied from pipe 4 via plenum space 8 and slot 10 in partition 9 (the slot 10 preferably extending from wall 51 to wall 52). Walls 24, 63, 26, 2, 51, and 52, bottom 29, and partition 21 enclose gas exit compartment 23, from which gas leaves via slot 22 in partition 21 (the slot 22 preferably running from wall 51 to wall 52) via plenum space 20 to pipe 5.

Perforate wall 60 comprises a series of inclined louvers 13 having outer edges 40 and inner edges 41 in respect to granular bed 18. The perforations of wall 60 are to be considered as being formed between respective inner edges 41 of adjacent louvers 13. The louvers are mounted in a manner such that they cooperate to support gas entry portions 61 of bed 18, viz., the angle of a line drawn through inner edge 41 of a given louver and outer edge 40 of the next subjacent louver should preferably be less than about 25° from the horizontal, an angle less than the angle of repose of most granular materials that might preferably be employed in bed 18. It will be seen that gas entry portions 61 are transversely disposed, upwardly spaced, and separated by the interposed supporting members 13, the gas entry portions having gas entry faces 39 that are substantially contiguous with outer edges 40.

Gas exit portions of bed 18 are seen at 62, and are spaced from inner edges 41 of louvers 13.

Pipe 30 connects gas exit compartment 23 with tank 32, quick-opening valve 31 being provided to isolate tank 32 from space 23. Tank 32 is connected to source 36 of gas under pressure via line 34 and valve 35. Pressure gauge 33 is provided to help adjust the pressure of gas in tank 32.

Figure 3:
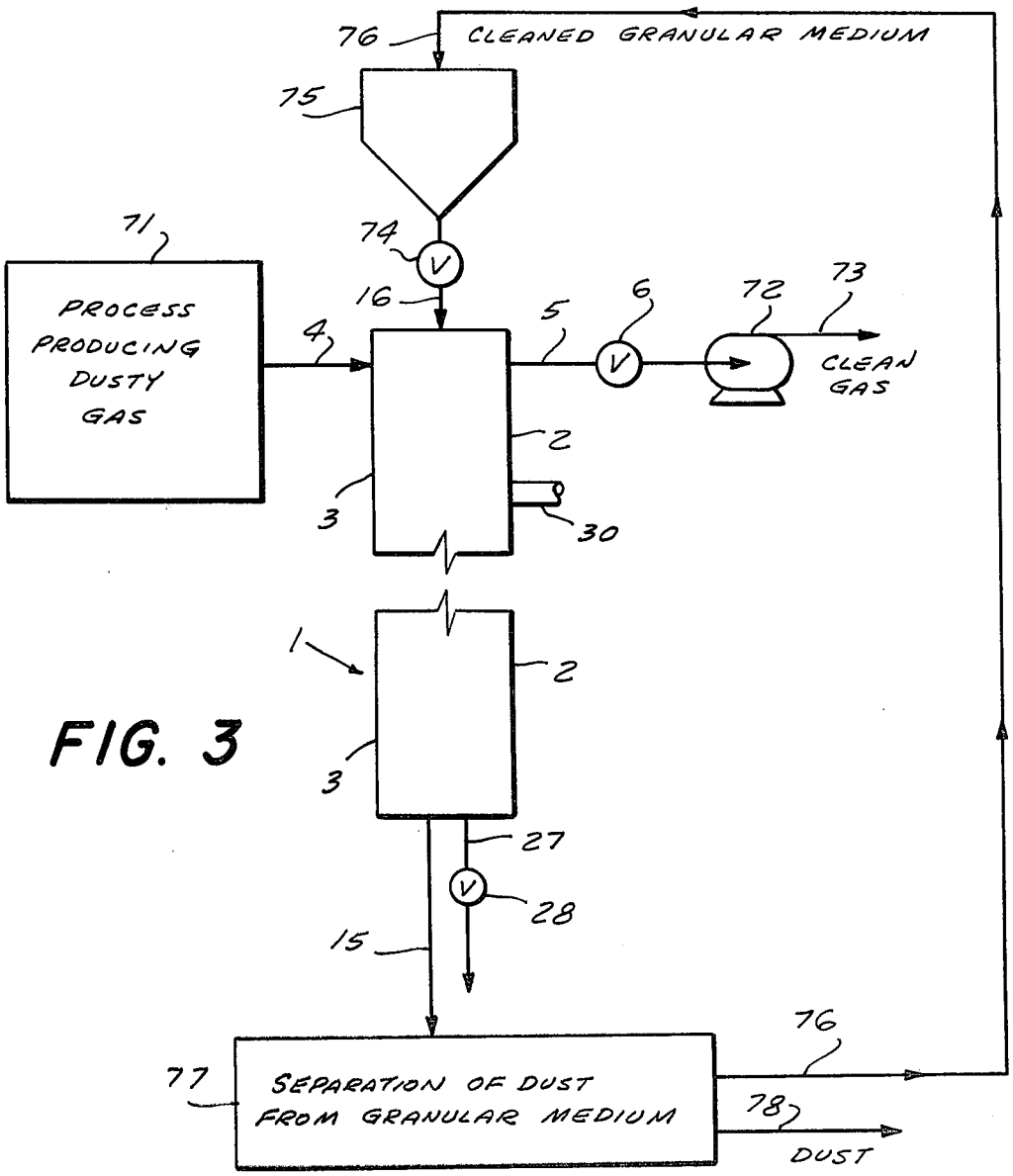
FIG. 3 is a schematic diagram illustrating use of the invention to filter a dusty gas.

In operation of panel bed 1 as a gas filter, for example, the panel bed 1 is initially charged with granular material such as quartz sand from line 16, filling spaces 19, 18, and 17 as shown in FIG. 1. Panel bed 1 is connected to a process 71 producing a dusty gas via gas-entry pipe 4, as shown in FIG. 3, and the gas is caused to flow forwardly through panel bed 1 by opening valve 6 in pipe 5. If process 71 does not supply gas at a sufficient pressure to cause the gas to flow readily through panel bed 1, optional blower 72 is conveniently provided to carry gas from pipe 5 to line 73 for conducting clean gas from the system. Periodically, tank 32 is filled with gas at pressure from supply 36, valve 35 is closed, valve 6 is closed to interrupt the flow of gas being filtered, and valve 31 is opened quickly to produce the specified transient reverse flow from compartment 23 to compartment 11. Pipe 15 is provided to withdraw filter cake and granular material spilled from surfaces 39. As seen in FIG. 3, pipe 15 advantageously conducts the spilled solids from the bottom of space 11 to means 77 for separating dust and granular medium, for example, by screening or by elutriating dust away from the granular medium. Pipe 78 is provided for withdrawal of dust from means 77, and pipe 76, for return of granular medium to supply hopper 75, from which the medium may be returned to panel bed 1 via valve 74 and pipe 16. After a wait of a few seconds for dust to settle to the bottom of space 11, valve 31 is closed, and valve 6 is opened to resume filtration by the freshly cleaned bed 18.

As fluid dynamicists will readily appreciate, for any given porosity of bed 18, there is a wide range of combinations of size of valve 31, speed of its opening, size of tank 32, pressure therein, length and diameter of line 30, and dimensions of compartment 23 that will yield the specified reverse transient flow of gas. The rate of rise of the reverse pressure difference produced by the transient reverse flow, the length of time the flow sustains a pressure difference between 23 and 11 beyond a specified minimum pressure difference, and the extent to which the peak pressure difference produced by the flow exceeds a specified minimum — these are all functions of the aforementioned variables (including the porosity of bed 18), together with a lesser influence arising from the dimensions of plenum 20, the size of slot 22, and the diameter of pipe 5 and its length before valve 6. Competent fluid dynamicists will be able to calculate such time lengths and such peak pressures as will comport with the specifications herein in respect to the aforementioned first and second critical minimum pressure differences, given knowledge of these differences.

These critical minimum pressure differences are best determined experimentally for a given configuration of walls 60 and 63 and for a given granular medium in bed 18, as discussed hereinafter. The tests may conveniently be conducted on a relatively small scale. In tests of this type that I have conducted, I have for greater convenience installed rapid-response transducers 37 and 38, as shown in FIG. 1, to report instantaneous pressure readings from compartments 11 and 23 respectively. Those skilled in fluid dynamics, however, would be able to conduct similar tests and derive, through calculations based upon the variables stated above, the instantaneous pressure levels that arise during their tests in the two compartments 11 and 23. Accordingly, those skilled in the art will recognize that transducers 37 and 38 need not be provided routinely in embodiments of the invention.

A wide range of granular materials are suitable for practicing the invention. In tests of the filtration of fly ash collected from the combustion of pulverized coal and redispersed in the laboratory in atmospheric air, I have found that a quartz sand substantially smaller than 20 mesh (U.S. Standard) gives the superior filtration performance that results when the dust being filtered forms a filter cake upon gas entry surfaces 39, so that relatively little fly ash penetrates deep within bed 18. Those skilled in filtration art will recognize that under these conditions, "fly ash filters fly ash" — i.e., for practical purposes, the filter cake does most of the filtering. [My fly ash comprised a mixture of particles about 90 weight per cent of which were smaller than about 80 microns, about 50 per cent smaller than 15 microns, and about 10 per cent smaller than 4 microns.] In similar tests using 10–14 mesh quartz sand, no filter cake formed, and inferior performance was realized. It will be understood by those skilled in the art that a minor percentage of coarse sand grains in the preferred sand mixture, that is generally smaller than 20 mesh, will not interfere with obtaining good performance, and a minor percentage (such as about 5 per cent) of sand as large as 4–8 mesh sometimes confers the advantage of improving the flowability of the sand mixture.

Generally speaking, I prefer higher gas velocities across bed 18 lower. I term the horizontal velocity of gas across perforate wall 60 and bed 18 the "face velocity". In a test filtering redispersed fly ash at a dust loading of about 3.7 grams per cubic meter and using 20–30 mesh quartz sand, I observed a percentage penetration of the dust across the bed of about 0.4 at a face velocity of 6.8 feet per minute (ft/min); that is to say, I observed a dust filtration efficiency of 99.6 per cent. In further tests at face velocities of 12, 22, and 33 ft/min and dust loadings of about 2.5, 2.6, and 5.9 grams per cubic meter, I observed dust penetrations of 0.7, 0.2, and 0.03 per cent respectively. In all of these tests, the reverse pressure difference produced by the puffback cleaning remained above the first critical minimum pressure difference for about 20 to 30 milliseconds.

I prefer to filter power-station fly ash at face velocities greater than about 30 ft/min. My panel was 4 inches across, and at such velocities and panel width, an overall capacity for filtering gas of about 600 cubic feet per minute per square foot of plan area occupied by the filter can readily be provided in a commercial-scale design. This is a considerably greater gas-treating capacity, per unit of ground area occupied, than an electrostatic precipitator designed for an efficiency of about 99 per cent generally affords.

In trials of panel bed filter 1 on redispersed fly ash, the upper limit on face velocity and the lower limit on size of the granular material charged to bed 18 appeared to be practical limits imposed by the advantage of keeping the pressure drop from pipe 4 to pipe 5 from becoming excessive or by the disadvantage of allowing a filter cake to develop on surfaces 39 so quickly that the time of operation of the filter between successive puffback cleanings becomes inconveniently short. In general, I prefer to filter fly ash at velocities below about 80 ft/min and using a granular medium larger than about 100 mesh.

In trials on 20–30 mesh quartz sand and at a fly ash loading of about 5.9 grams per cubic meter and at a face velocity of 33 ft/min, the initial pressure drop across the clean filter bed, from compartment 11 to compartment 23, was about 2 centimeters of water (2 cm). During a filtration cycle of about 6 minutes, the fly ash filter cake developed such that the pressure drop increased to about 3.6 cm, whereupon the bed was cleaned as hereinbefore described. In trials in which the reverse pressure difference brought about by the puffback remained above the first critical pressure difference for about 20 to 30 milliseconds, fly ash penetrations of about 0.03 per cent were observed after the third filtration cycle.

To my surprise, the penetration was greater during the first and second cycles: 0.3 and 0.05 per cent respectively. There is apparently a synergistic effect between my puffback cleaning technique and the filtering mechanism, an effect that leads to improved filtration efficiency. In a special test of a filter charged with carefully cleaned sand (first washed with water and then dried), the penetration was about 0.8 per cent. I believe that "dirty" sand filters better than clean sand because particles of fly ash adhere to the dirty sand and act as "nuclei" for growth of a new fly ash deposit. Presence of a little fly ash already stuck to the sand apparently helps the collection of additional fly ash. Although puffback generally restores the flow resistance of bed 18 to substantially its initial resistance, nevertheless, it is evident that puffback cleaning does not remove every particle of fly ash that has been filtered by the bed; a small quantity of fly ash that has penetrated into the bed is "advanced" by the body movement of sand created by the puffback toward the gas entry faces of the panel bed, where this small quantity of fly ash serves advantageously to promote the formation of a new filter cake of fly ash in the next filtration cycle.

Enjoyment of the aforementioned synergistic effect depends upon careful control of the time interval during which the reverse pressure difference remains above the first critical pressure difference. For filtration of fly ash at a loading of several grams per cubic meter, I prefer to use a time interval below about 50 milliseconds. At significantly longer times, penetrations greater than the aforementioned 0.03 per cent will be obtained, and the deterioration of performance will be marked at times of several hundred milliseconds. Use of such times, apart from other disadvantages, will produce such a large spill of filtration sand as to have the general effect of restoring the filter after each cleaning to essentially its initial condition when first filled with sand, and, under the conditions of the aforementioned trials, a penetration of about 0.3 per cent will be observed. At times of several hundred milliseconds, similar filtration trials at 6.8, 12, and 22 ft/min will provide penetrations of about 1.9, 2.5, and 1.2 per cent respectively, in contrast to the lower penetrations of 0.4, 0.7, and 0.2 per cent respectively for best practice of the instant invention. Further deterioration of performance will occur at even longer times, for the spill then takes on almost entirely the character of a localized spill, to be discussed hereinafter, that does not even remove filter cake from the gas entry faces of the panel.

Figure 4:
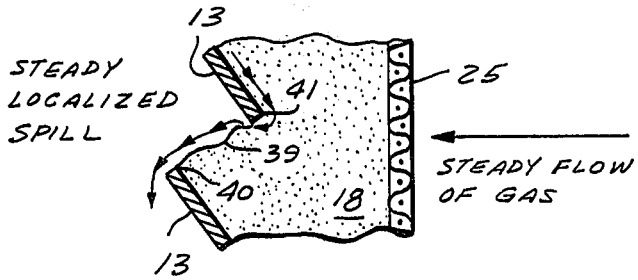
FIG. 4 illustrates the steady localized spill produced by a steady backflow of gas across the panel.
Figure 4:
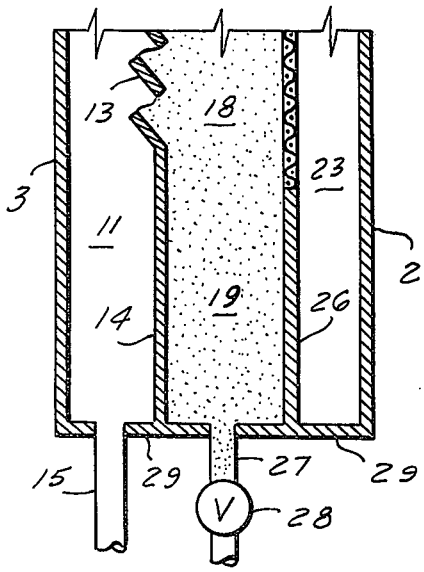

For convenient reference, FIG. 4 shows the steady localized spill of sand produced by a steady reverse flow of gas across bed 18. The first critical minimum pressure difference of the invention is readily determined in experiments in which the steady flow of gas is systematically varied, to observe the minimum flow that just produces the spill depicted in the figure. [More will be said about these experiments hereinafter.] Sand spills from a narrow zone immediately adjacent to edge 41, and the spilled sand originates from sand resting upon the upper surface of the louver 13 of which 41 is the edge. If a filter cake is present on surface 39, practically none of the filter cake will be found in the sand spill, even after a prolonged spill of the type shown in the figure!

I have conducted a large number of experiments with a panel similar to that seen in FIG. 1, using a number of valves 31 of various sizes and various speeds of opening, a number of reservoirs 32 of various volumes and with use of a range of pressure levels from supply 36, and with a range of the volume provided between valve 31 and perforate wall 25 (volume of pipe 30 and space 23). I have followed the instantaneous pressure in space 23 and space 11 with rapid-response transducers 38 and 37 respectively, recording data from the transducers by a polaroid camera directed toward an oscilloscope displaying the data. I have also conducted experiments with steady flow of gas as seen in FIG. 4. I have made motion pictures at high speed (3,000 frames per second) of the behavior of the sand bed under various flow conditions.

Figure 5C:
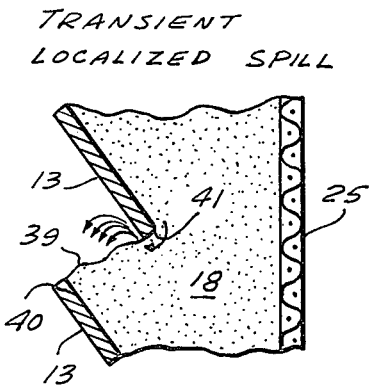
FIG. 5C illustrates the transient localized spill caused by a transient reverse flow of gas that produces a rise and fall in pressure difference typified by the curves seen in FIGS. 5A and 5B.
Figure 5A:
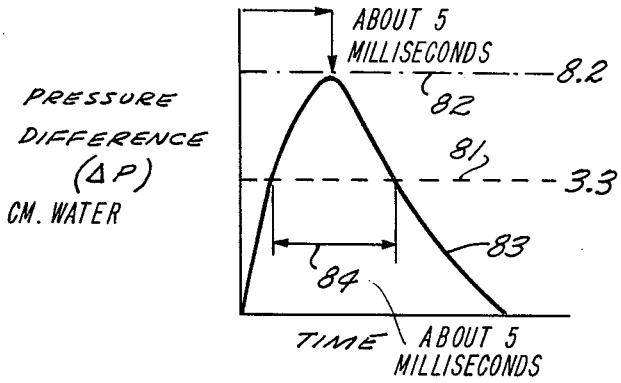
Figure 5B:
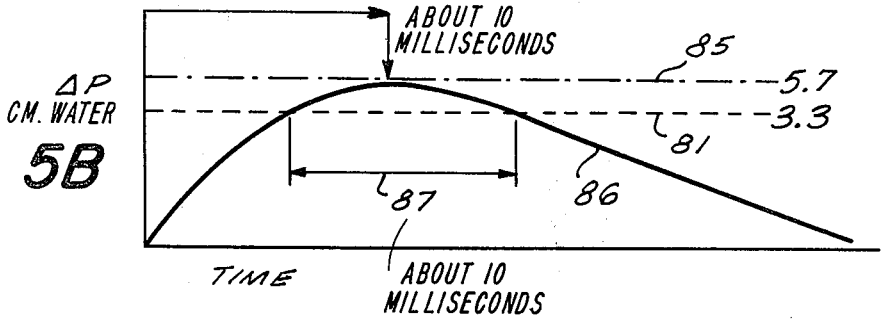

FIGS. 5A, 5B, and 5C refer to a reverse transient flow of an intensity insufficient to accomplish puffback cleaning. Such a reverse transient flow is capable of producing a transient localized spill, as illustrated in FIG. 5C, if the flow produces a pressure difference from space 23 to space 11 that momentarily exceeds the first critical minimum pressure difference. Curves 83 and 86 in FIGS. 5A and 5B illustrate curves of pressure difference ($\Delta P$) that are of sufficient intensity to cause a transient localized spill but not of sufficient intensity to cause a body movement of filter sand. In both FIGS. 5A and 5B, the dashed line 81 is the first critical minimum pressure difference of the invention, viz., the difference at which a steady flow of gas from space 23 to space 11 will just produce a localized steady spill of filter sand as seen in FIG. 4. The first critical $\Delta P$ depends only upon the physical characteristics of the granular material (depending primarily upon its "soil" strength, which in turn depends primarily upon friction forces that develop between moving particles, their size, shape, density, and cohesivity) and upon the geometry of bed 18 and walls 60 and 63.

The second critical $\Delta P$ (I will discuss its determination hereinafter) is greater the more rapid the rise in the reverse pressure difference. For example, the first critical $\Delta P$ for 40–50 mesh quartz beach sand was found for a given arrangement to be about 3.3 cm (line 81 in FIGS. 5A and 5B). For a rise in $\Delta P$ that peaked in about 5 milliseconds (curve 83 in FIG. 5A), the second critical minimum difference for the arrangement was found to be about 8.2 cm (line 82). Time interval 84 was about 5 milliseconds. In another experiment, where a larger space 23 was provided, the $\Delta P$ peaked in about 10 milliseconds (curve 86 in FIG. 5B), and the second critical $\Delta P$ was found to be about 5.7 cm (line 85). Time interval 87 was about 10 milliseconds.

Figure 6A:
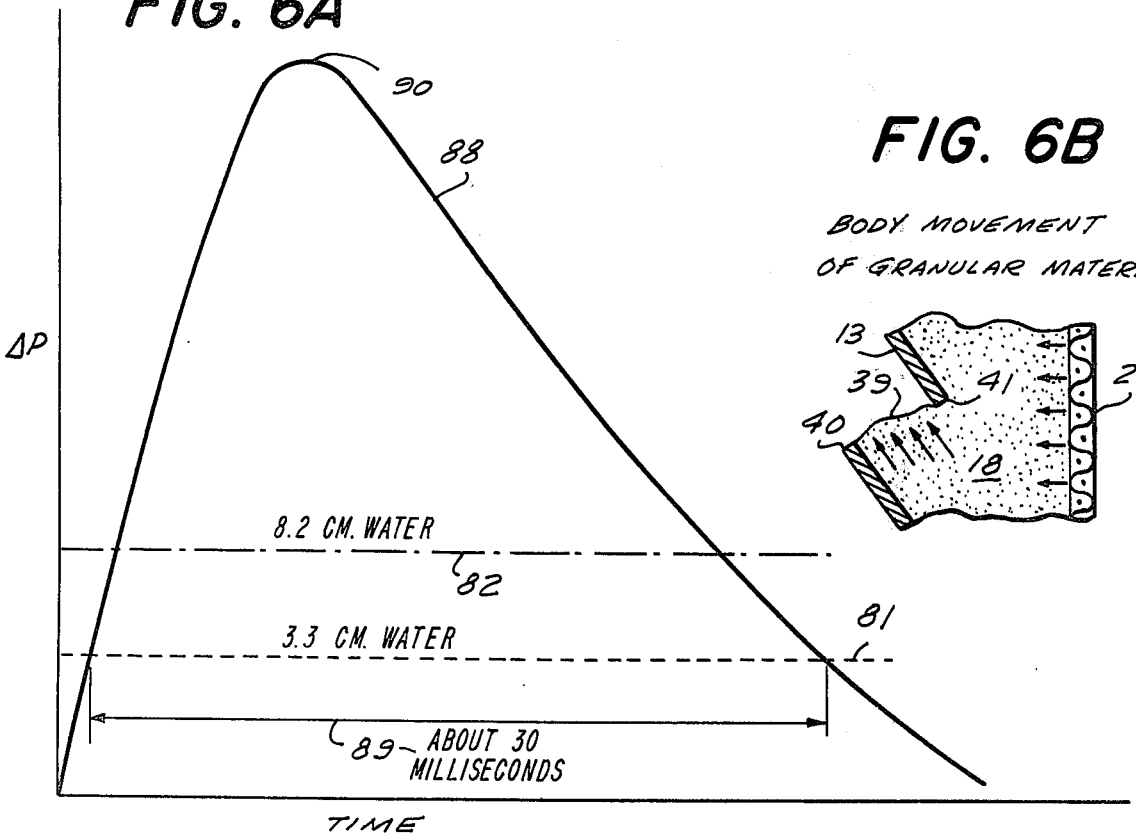
FIG. 6B shows the desired body movement of granular material effected by a transient reverse flow of gas that produces the specified rise and fall in pressure difference, as typified by the curve seen in FIG. 6A.
Figure 6B:
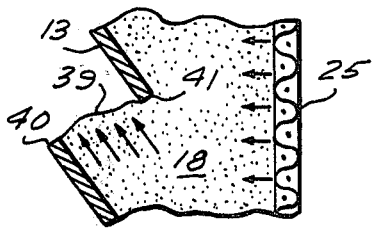

In an experiment with the same physical arrangement as that used in the experiment leading to FIG. 5A, a more intense puffback produced curve 88 of FIG. 6A, producing a peak $\Delta P$ at 90, well beyond the second critical $\Delta P$ at 82. Time interval 89 was about 30 milliseconds. The experiment produced a body movement of granular material as seen in FIG. 6B. The entire mass of bed 18 moved bodily a short distance away from screen 25, and sand in the vicinity of surface 39 moved bodily toward this surface, producing a spill.

Visual observation of a panel bed with a side window of glass (one of the walls 51 or 52 in FIG. 2) readily leads to an appreciation of the body movement indicated in FIG. 6B. High-speed motion pictures, however, reveal what the eye does not at first readily appreciate, viz., that the motion of the sand is initiated by a transient localized spill, like that shown in FIG. 5C. From the point of view of soil mechanics, the shear strength of sand bed 18 is least at surface 39, where no overlying sand is pressing downward, and it is understandable that "failure" of the bed under influence of the transient reverse pressure difference begins at this surface at edges 41 of louvers 13, the points closest to space 23. After a time interval generally between about 5 and 15 milliseconds beyond the time of the eruption of the transient localized spill, a body movement begins, i.e., a "body failure" of the sand bed has occurred. It is known that the shear strength of a dry sand is greater the more rapid the loading (see *Transactions of the American Society of Civil Engineers*, volume 128, part I, pages 1553–1587, 1963), and this fact is no doubt related to my discovery that the second critical minimum pressure difference is greater the more rapid the rise in the difference.

I have determined the second critical pressure difference by plotting the spill of sand versus peak difference 90 in a series of experiments. I find that the spill is practically linear with the peak pressure, and an extrapolation of the straight line defined by spills at generally higher values of peak pressure 90 back to zero spill defines the second critical pressure difference. Actual spills at peak pressure differences in the vicinity of the second critical difference, so defined, are slightly greater than the extrapolated straight line would indicate, because the aforementioned transient localized spill, that initiates the motion of the sand, produces a small amount of spill.

Figure 7A:
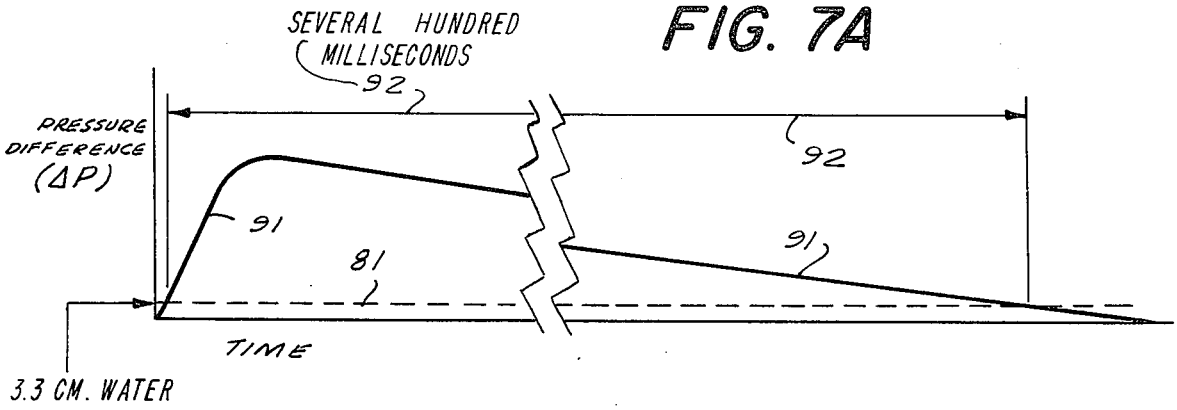
FIG. 7B shows the undesirable localized "afterspill" that ensues when a transient reverse flow of gas produces a rise and fall in pressure difference such as that seen in FIG. 7A.
Figure 7B:
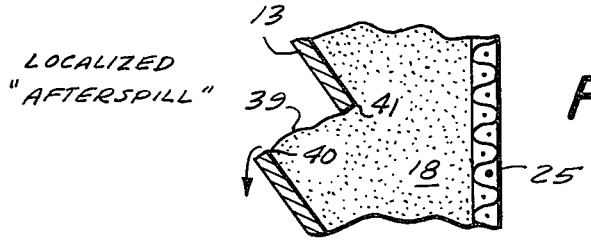

As will be evident from the foregoing discussion, the motion of sand produced by my experiments had in part the character of the transient localized spill seen in FIG. 5C and in part the character of the body movement illustrated in FIG. 6B. The body movement was predominant, unless the time interval during which the reverse pressure difference exceeded the first critical minimum difference persisted too long. For a pressure difference curve like curve 91 in FIG. 7A (plotted to a scale different from that used in plotting FIGS. 5A, 5B, and 6B), where time 92 was several hundred milliseconds, I observed a persistent, prolonged "afterspill" of sand from edges 40 as depicted in FIG. 7B. Such an afterspill produces a useless loss of sand from bed 18, only causing performance of the bed as a filter to deteriorate (as discussed hereinbefore). Moreover, at a long time 92, the entire movement took on much more of the character of the localized spill and less of the preferred body movement, and the distribution of the spill from gas entry surfaces 39 became poor, there being a much larger spill from the top surfaces of my test arrangement than from the bottom.

A time interval of about 150 milliseconds represents an approximate upper limit for acceptable performance, and I prefer a time interval below 100 milliseconds and preferably below 50 milliseconds, especially for use of the panel bed 1 as a filter.

Lest there be a misunderstanding, I should remark that a small afterspill, like that seen in FIG. 7B, persists even in the specified operation of my panel bed puffback cleaning procedure, as exemplified by FIG. 6A. The small afterspill is seen for sometimes more than 100 milliseconds after the curve 88 returns below critical pressure difference 81, even though time interval 89 may have been only about 30 milliseconds. This small afterspill appears to be merely a consequence of a rearrangement of surface 39 to a final stable configuration.

Satisfactory results have been obtained for a range of rate of rise of the reverse pressure difference produced by the reverse transient flow. Satisfactory results have been obtained when peak 90 (see FIG. 6A) comes roughly one-half way through time interval 89, even when the time interval approaches the specified upper limit of 150 milliseconds, but I prefer that peak 90 occur at least in about the first one-third of time interval 89, and I believe that the earlier occurrence of peak 90 produces a sand motion partaking more of the character of the preferred body movement and less of the character of the undesirable transient localized spill.

A practical minimum time interval for operation of the arrangement of FIG. 1 appears to be about 3 to 5 milliseconds, given the practical requirement that space 23 must be large enough to accommodate a flow of gas leaving wall 63 at the preferred face velocity of more than about 30 ft/min. One might, for example, achieve an extremely short time interval by mounting a large number of blank cartridges on wall 2 and firing them simultaneously to discharge gas explosively into space 23, and I believe that the second critical minimum pressure difference would then be appreciably larger, other things remaining equal, than any that I have been able to observe with the experimental arrangements available to me.

Figure 8:
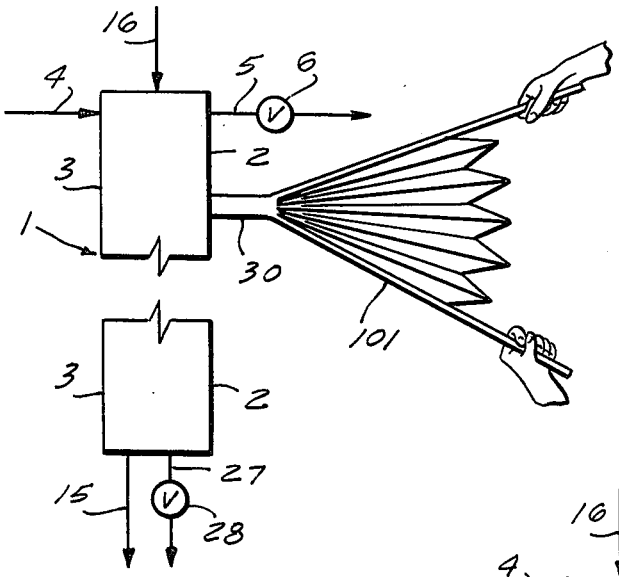
FIGS. 8, 9, and 10 show alternative arrangements for effecting a transient reverse flow of gas across the panel bed.
Figure 9:
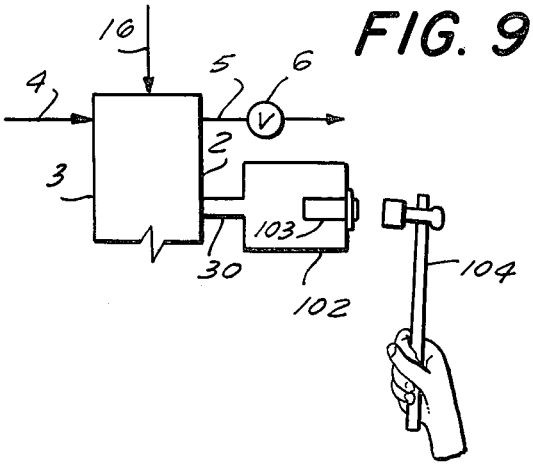

FIG. 8 shows how a bellows 101 can deliver a suitable reverse transient flow of gas to panel bed 1 via pipe 30. FIG. 9 shows how such a suitable flow can be delivered by attaching to pipe 30 a chamber 102 in which is mounted a blank cartridge 103 that may be fired by striking it with hammer 104.

Figure 10:
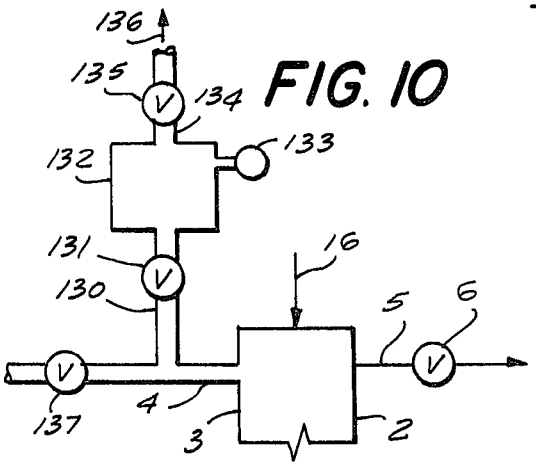

FIG. 10 shows an alternative arrangement that may be preferred if the panel bed is used to treat gas at elevated pressure. Tank 132 is connected to line 4 via pipe 130 and quick-opening valve 131. The pressure of gas in tank 132 is reduced by connecting the tank to a receiver of gas at low pressure 136 via pipe 134 and valve 135. Pressure gauge 133 is provided to assist in adjusting the pressure in tank 132. Valve 135 is then closed, valve 137 in line 4 is closed, stopping the flow of gas to be treated, and valve 131 is opened quickly to produce a transient flow of gas from line 5 to line 4 and thence into tank 132. Valve 131 is then closed, valve 137 opened, and a new treating cycle can begin.

For best performance, puffback should create a spill from each surface 39 of the panel bed as close as possible to the average value reckoned from the sum of the spills. The spill created at a given surface 39 depends upon the degree of packing of the sand in bed 18 (i.e., the porosity or voidage of the bed) in the vicinity of the surface. Accordingly, best performance requires that the porosity of the bed be as uniform as possible.

I have found that unequal sand spills are frequently encountered during the earliest puffback cleaning cycles after the panel bed has just been filled with fresh granular material. There is often a tendency for spills to be greater from surfaces 39 near the top of the panel bed, and sometimes surfaces near the bottom yield almost no spill. This behavior greatly impeded my proper understanding of the best time interval for the reverse $\Delta P$ to exceed the first critical minimum, for with use of puffbacks of the intensity that I now prefer, I eventually understood that many puffback cleaning cycles are sometimes needed before the spills finally become relatively uniform, and at the outset of my experiments, my patience was not always sufficient. I then discovered that it sometimes pays to impose a "strong" puffback of greater intensity than that contemplated for subsequent operations, and thereafter the bed quickly approaches the desirably uniform porosity condition after several puffbacks of the preferred strength. I found that this behavior is related to the fact that, for a given puffback intensity, there corresponds an ultimate bed porosity closely approached after a number of puffback cycles. The ultimate porosity is approached much more quickly from a loose bed condition than from a densely packed bed.

These discoveries are understandable in light of known facts of soil mechanics. It is known that a densely packed dry sand develops a large shearing strength under relatively small shearing strain, but beyond a peak strength, the strength declines under larger strain to an assymptotic value. A loosely packed dry sand, on the other hand, exhibits low shearing strength at low strain, and develops strength to the same assymptotic value as the strain is increased. Generally speaking, the densely packed sand specimen expands during an experiment in which strain is gradually increased, while a loosely packed specimen contracts in volume, each specimen reaching ultimately about the same porosity.

During normal operation of the panel bed, the granular medium adjacent to screen 25 in a bottom zone of the panel bed essentially does not participate in the overall movement of the medium, and remains permanently in the bed. The zone is defined by a plane passing through the bottom edge 41 of the lowest louver 13 (attached to wall 14 in the drawing of FIG. 1) and passing upwardly and inwardly through bed 18 toward screen 25 at the angle of the failure plane characteristic of the granular medium (generally speaking, about 65° to 70° from the horizontal). This material tends to remain permanently at the porosity afforded by the procedure for initially filling the panel bed, and in general, there is risk that a low porosity in this zone will depress the quantity of medium spilled from several of the bottom surfaces 39 of the panel bed. To offset this risk, I prefer to extend screen 25 to an elevation somewhat below the bottom louver, as shown in FIG. 1.

It will be understood that the first critical minimum reverse pressure difference is to be determined when substantially all of the panel bed has been brought to a substantially uniform porosity appropriate for a given practice of puffback. If a small steady reverse flow is then imposed and if this is slowly increased, a moment will occur at which one or more of the gas entry faces 39 just begin to spill sand, generally where imperfections of the panel bed 1 construction provide surfaces 39 a bit steeper than the average, and also generally at the top surface 39.

Figure 11:
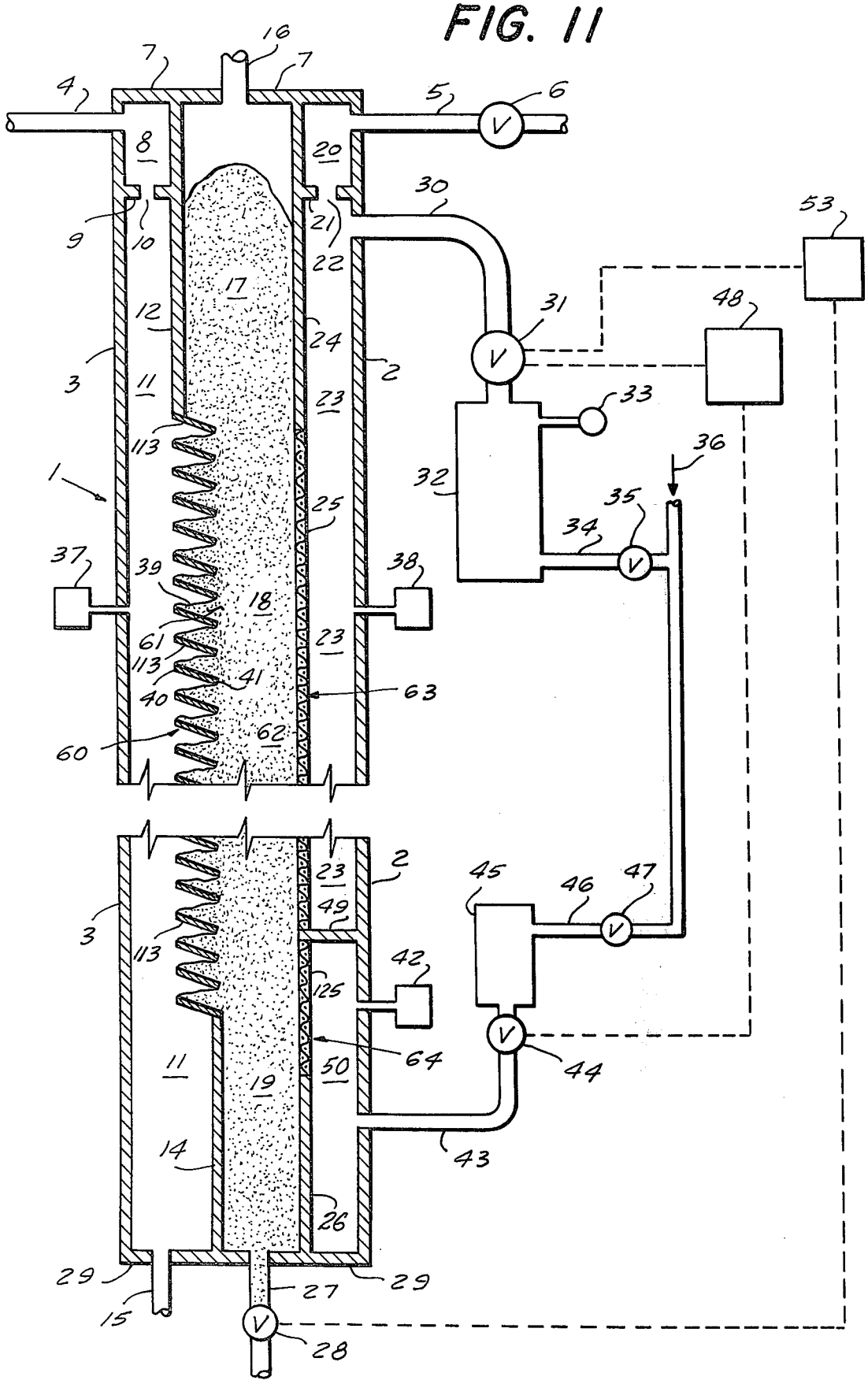
FIG. 11 shows an alternate preferred contacting panel bed, fitted with means for effecting a discharge of a controlled quantity of granular material from substantially the bottom of the panel bed.

Before I appreciated the difficulty of achieving the required uniform porosity when a panel bed is initially provided with the bed in a densely packed condition, I was not able to obtain satisfactory performance from a panel bed having louvers at a shallow angle to the horizontal, like louvers 113 in FIG. 11. Such louvers provide a large total gas entry surface, advantageous if the panel bed is to be used to filter dust from a gas, since more filtered dust can be accumulated for a given rise in pressure drop across the bed between successive cleanings. Even such an aforementioned "strong" puffback often fails to place the panel bed of FIG. 11 in a condition for operation, since the strong puffback often merely produces large localized spills from the top of the panel without producing sand movement at the bottom.

I have found that a panel like that seen in FIG. 11 can be placed in readiness for operation by discharging a controlled quantity of granular medium from substantially the bottom of the panel. This will loosen the entire panel bed 18 by producing a downward motion of this bed, provided the motion includes medium near the top of the panel. Discharging too small a quantity would merely loosen the bottom of the panel.

In FIG. 11, gas exit compartment 23 is bounded at the bottom by bottom 49 rather than by bottom 29. Perforate wall 60 is extended to a lower elevation than perforate wall 63. Opposite this extension of wall 60 lies perforate wall 64 comprising wiremesh screen 125. Plate 49 together with wall 64, wall 2, wall 26, wall 51, wall 52, and bottom 29 enclose space 50, which is connected to tank 45 by pipe 43, quick-opening valve 44 being provided to isolate tank 45 from space 50. Tank 45 is connected to source 36 of gas under pressure via line 46 and valve 47. After bed 18 has been filled with granular medium and with tank 45 under pressure, opening valve 44 produces a spill of sand from the lower surfaces of wall 60, thereby discharging sand from bed 18 and loosening the sand in the bed. Transducer 42 may conveniently be provided to assist tests elucidating the performance of tank 45 and valve 44 in discharging sand. It will be recognized, however, that it does not matter much what kind of motion produces a spill of sand from lower surfaces 39 opposite screen 125. Control means 48 are conveniently provided to open valve 44 before valve 31 is actuated in normal operation of panel bed 1. Sometimes, valve 44 may advantageously be actuated intermittently and on a schedule during the operation, to prevent settling of the bed, especially near the bottom.

An alternative procedure is to provide for opening of valve 28 to discharge sand from space 19, the time of the opening being controlled by control means 53, that can also be arranged to control both the opening of valve 31 and the on-off actuation of valve 28 according to any desired schedule.

I do not wish my invention to be limited to the particular embodiments illustrated in the drawings and described above in detail. Other arrangements will be recognized by those skilled in the art, as well as purposes other than those discussed herein which the invention can advantageously serve.

Other geometries for perforate walls 60 and 63 can serve, and a preferred geometry is disclosed in my aforementioned co-pending application number 4. It may sometimes be desirable to mount a cloth (not shown in FIG. 1) between screen 25 and bed 18, such as canvas or felt or a fabric woven of fiberglass or graphite fibers or other suitable fibers.

The foregoing descriptions have been directed to a single panel bed to facilitate understanding my invention. In an actual installation treating a large throughput of gas, it might be desirable to have a number of panels. For example, several panels might be arranged in parallel, with adjacent panels facing in opposite directions, and spaced from one another to form gas passages therebetween.

Another suitable arrangement of the panel bed would be to build each of walls 60 and 63 to form a circle or a square or a hexagon when viewed in plan, so that panel bed 18 encloses one or the other of the space 11 or the space 23.

It will also be understood by those skilled in the art that the intensity of the puffback created by opening valve 31 in FIG. 1 or valve 131 in FIG. 10 can be moderated by supplying means for sharply closing these valves at a short time interval thereafter, before the pressure in tank 32 or 132 respectively has closely approached the pressure in panel bed 1. A further alternative would be to supply an additional valve (not shown in the figures) in line 30 or 130 respectively that would close sharply at a short time interval after valve 31 or 131 is opened.

I claim:

1. A method of contacting gas and granular material with each other to effect physical or chemical treatment of at least one of them, comprising:

a. arranging granular material having apertured outer walls in a bed having a plurality of transversely disposed upwardly spaced gas entry portions separated by interposed supporting members having outer and inner edges with respect to the bed wherein said gas entry portions have gas entry faces substantially contiguous with said outer edges and said bed having gas exit portions spaced from said inner edges;

b. forwardly flowing gas in a substantially continuing flow during said treatment through the gas entry portions of the granular material bed and outwardly from the gas exit portions to effect said treatment of one of said gas and granular material;

c. thereafter causing a transient flow of gas to move in the direction in reverse to the flow of said gas in (b); and d. causing said transient reverse flow to produce first, a rise in the pressure difference at a given rate of rise between the gas exit portions and the gas entry portions and subsequently a fall in the pressure difference between the gas exit portions and the gas entry portions, said pressure difference produced by said transient reverse flow remaining greater than a first critical minimum difference for a time interval between about 5 and about 50 milliseconds, said first critical pressure difference being that at which a steady flow of gas in said reverse direction just produces a localized spill of granular material from the gas entry faces, and the pressure difference produced by said transient reverse flow peaking to a top value beyond a second critical minimum difference, which is the pressure difference at which a transient flow of gas in the reverse direction producing said pressure difference at said given rate of rise just initiates a body movement of the granular material supported by said members toward the gas entry faces to spill a portion of the granular material from the bed.

2. A method of treating a gas involving the separation and removal of particulate material by means of a filter of granular material which comprises a. arranging granular material having apertured outer walls in a bed having a plurality of transversely disposed upwardly spaced gas entry portions separated by interposed supporting members having outer and inner edges with respect to the bed wherein said gas entry portions have gas entry faces substantially contiguous with said outer edges and said bed having gas exit portions spaced from said inner edges;

b. forwardly flowing gas in a substantially continuing flow during said treatment through the gas entry portions of the granular material bed and outwardly from the gas exit portions to effect said treatment of one of said gas and granular material;

c. thereafter causing a transient flow of gas to move in the direction in reverse to the flow of said gas in (b); and d. causing said transient reverse flow to produce first, a rise in the pressure difference at a given rate of rise between the gas exit portions and the gas entry portions and subsequently a fall in the pressure difference between the gas exit portions and the gas entry portions, said pressure difference produced by said transient reverse flow remaining greater than a first critical minimum difference for a time interval between about 5 and about 50 milliseconds, said first critical pressure difference being that at which a steady flow of gas in said reverse direction just produces a localized spill of granular material from the gas entry faces, and the pressure difference produced by said transient reverse flow peaking to a top value beyond a second critical minimum difference, which is the pressure difference at which a transient flow of gas in the reverse direction producing said pressure difference at said given rate of rise just initiates a body movement of the granular material supported by said members toward the gas entry faces to spill a portion of the granular material from the bed.

3. The method of claim 2 including the step of loosening said granular material in said bed by discharging a controlled quantity of said material from substantially the bottom of said bed to produce a downward motion of said material in the bed including material at substantially the top of the bed.

* * * * *